US009828798B1

(12) United States Patent
Lahita

(10) Patent No.: US 9,828,798 B1
(45) Date of Patent: Nov. 28, 2017

(54) RADIO FREQUENCY AND ACOUSTIC SHIELDING DOOR

(71) Applicant: Shielding Resources Group, Inc., Tulsa, OK (US)

(72) Inventor: Michael John Lahita, Tulsa, OK (US)

(73) Assignee: Shielding Resources Group, Inc., Tulsa, OK (US)

( * ) Notice: Subject to any disclaimer, the term of this patent is extended or adjusted under 35 U.S.C. 154(b) by 30 days.

(21) Appl. No.: 15/076,921

(22) Filed: Mar. 22, 2016

(51) Int. Cl.

| | |
|---|---|
| ***E06B 3/00*** | (2006.01) |
| ***E06B 5/00*** | (2006.01) |
| ***E06B 5/20*** | (2006.01) |
| ***E06B 7/16*** | (2006.01) |

(52) U.S. Cl.
CPC ..... *E06B 5/00* (2013.01); *E06B 5/20* (2013.01); *E06B 7/16* (2013.01)

(58) Field of Classification Search
CPC ..... E06B 5/00; E06B 7/16; E06B 5/20
USPC ..... 49/501
See application file for complete search history.

(56) References Cited

U.S. PATENT DOCUMENTS

| | | | | |
|---|---|---|---|---|
| 3,051,260 | A * | 8/1962 | Eckel | E06B 5/20 181/287 |
| 3,770,536 | A * | 11/1973 | Haigh | E04C 2/24 156/182 |
| 4,069,618 | A | 1/1978 | Geiss | |
| 4,370,831 | A | 2/1983 | Hamilton | |
| 4,623,752 | A | 11/1986 | Steen et al. | |
| 4,642,416 | A | 2/1987 | Rogner | |
| 4,677,251 | A | 6/1987 | Merewether | |
| 4,786,758 | A | 11/1988 | Zielinski | |
| 4,794,206 | A | 12/1988 | Weinstein | |
| 4,817,337 | A * | 4/1989 | Lahita | H05K 9/0016 174/366 |
| 4,828,910 | A * | 5/1989 | Haussling | B29C 70/08 428/423.1 |
| 4,910,920 | A * | 3/1990 | Nichols | H05K 9/0016 174/361 |
| 4,953,324 | A * | 9/1990 | Herrmann | E05F 7/02 174/382 |

(Continued)

FOREIGN PATENT DOCUMENTS

| | | |
|---|---|---|
| CN | 202731662 | 2/2013 |
| CN | 203350304 | 12/2013 |

OTHER PUBLICATIONS

MRI RF Shielded Doors; ETS-Lindgren, Oct. 2009—500 Bell (c) 2007.

(Continued)

*Primary Examiner* — Jerry Redman
(74) *Attorney, Agent, or Firm* — Head, Johnson, Kachigian & Wilkinson, PC

(57) ABSTRACT

A radio frequency (RF) and acoustic shielded door that has a door leaf with an acoustically insulated core. The perimeter of the door leaf is banded with a conductive contact channel, which is electro-mechanically bonded to a shielding media that is applied to the door face. A conductive angled contact is mechanically attached at a bottom of the door. An acoustic or radio frequency gasket seal assembly is attached to the door frame, and the gasket seal assembly is adjustable so that a complete seal can be formed around the head, jamb and sill of the door.

20 Claims, 6 Drawing Sheets

(56) References Cited

U.S. PATENT DOCUMENTS 4,982,053 A * 1/1991 Thornley ..... H05K 9/0015 174/366
5,013,869 A * 5/1991 Breithaupt ..... E06B 5/18 174/368
5,045,636 A 9/1991 Johnasen et al.
5,223,670 A 6/1993 Hogan et al.
5,335,464 A * 8/1994 Vanesky ..... A61B 5/04005 174/374
5,371,987 A 12/1994 Hirsch et al.
5,569,878 A * 10/1996 Zielinski ..... H05K 9/0001 174/364
6,170,203 B1 * 1/2001 Schlapfer ..... E05F 17/002 174/353
6,323,419 B1 11/2001 Toy
6,519,899 B1 2/2003 Hurzeler
6,914,184 B1 * 7/2005 Lahita ..... H05K 9/0015 174/374
6,992,246 B2 1/2006 Christou
7,117,640 B2 10/2006 Hurzeler
7,246,681 B2 7/2007 Christen
7,921,965 B1 * 4/2011 Surace ..... B32B 7/12 181/285
8,028,800 B2 * 10/2011 Ravnaas ..... E04B 1/86 181/284
8,074,400 B2 * 12/2011 Speyer ..... E05C 9/063 49/303
8,176,682 B2 * 5/2012 Gaviglia ..... E06B 5/18 49/400
8,181,417 B2 * 5/2012 Surace ..... B32B 7/12 52/309.9
8,327,602 B2 * 12/2012 Smith ..... E04G 23/02 52/181
8,397,864 B2 * 3/2013 Tinianov ..... E04B 1/86 181/290
8,590,272 B2 * 11/2013 Thomas ..... B32B 7/14 52/783.13
8,656,643 B2 * 2/2014 Thielmann ..... E05C 9/063 49/303
8,678,133 B2 * 3/2014 Clausi ..... B32B 25/14 156/60
9,051,731 B2 * 6/2015 Thomas ..... E04B 1/84
9,482,044 B2 * 11/2016 Wong ..... E06B 5/113
9,512,613 B2 * 12/2016 Blades ..... B32B 37/12
9,631,361 B2 * 4/2017 Clausi ..... E04B 1/84
2004/0065507 A1 * 4/2004 Jacobsen ..... E04B 1/84 181/290
2006/0057345 A1 * 3/2006 Surace ..... B32B 7/12 428/213
2006/0108175 A1 * 5/2006 Surace ..... E04B 1/86 181/285
2009/0000245 A1 * 1/2009 Tinianov ..... B32B 7/12 52/782.1
2010/0170746 A1 * 7/2010 Restuccia ..... B29C 70/083 181/290
2010/0230206 A1 * 9/2010 Tinianov ..... B32B 3/00 181/286
2011/0165429 A1 * 7/2011 Tinianov ..... B32B 7/12 428/522
2015/0152679 A1 6/2015 Kolobayev et al.

OTHER PUBLICATIONS

Sound Solutions from Zero International, High-Performance Acoustical Gasketing Systems.
Sound Trap 49 STC Sealing System, Product Catalog #80, p. 57, www.zerointernational.com.
A Reliable and Adjustable Shielding System for Continuous-Use Doors, Product Catalog #80, p. 53, www.zerointernational.com.

* cited by examiner

RADIO FREQUENCY AND ACOUSTIC SHIELDING DOOR

CROSS REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

This invention relates generally to a radio frequency (RF) and acoustic shielding door for enclosures, and more particularly, an RF and acoustic shielding door having improved RF and acoustic attenuation for a shielded enclosure.

2. Description of the Related Art

Developments continue to be made in RF shielding and RF shielded rooms for research, medical, military and other government uses. Enclosures with RF shielding, in some cases, also require soundproofing or acoustic insulation in order to protect against the transmission of sound from either within or outside of the shielded enclosure. In production environments, electronics require RF-noise free areas for testing and other activities, and in medical environments, magnetic resonance images provided by MRI operations are distorted by RF that emanate from nearby elevator motors, cell phones, television stations, radio stations and even passing vehicles. In secure RF shielded environments, the need may be to keep electronic and/or audio transmissions from exiting the environment or to prevent electronic and/or audio eavesdropping from outside of the shielded enclosure.

RF and acoustic shielding occurs around the perimeter of the door, namely at the seal and through the door panels. For acoustic purposes, control of the passage of sound waves focuses on the door seal as well as on the mechanical door for controlling and preventing the passage of sound waves through the air and also by vibration through materials. In addition to providing RF shielding and soundproofing, the door must also be functional, and the RF and soundproofing seals must be designed in such a manner that they do not wear, break through use. Moreover, since door alignment is a common problem and any unsealed gams allow sound waves to travel through.

Therefore, it is desirable to provide an improved RF and acoustic shielding door for shielded enclosures.

It is further desirable to provide an RF and acoustic shielding door for attenuating RF radiation and soundproofing in a myriad of environments, including medical and nonmedical.

It is yet further desirable to provide an RF and acoustic shielding door having an acoustic seal assembly that is adjustable so that a complete seal can be formed around the door head, jamb and sill.

It is still yet further desirable to provide an RF and acoustic shielding door that provides RF attenuation and soundproofing for different frequencies within existing trim sizes.

Other advantages and features of the invention will be apparent from the following description and from the claims.

BRIEF SUMMARY OF THE INVENTION

In general, the invention relates to a radio frequency and acoustic shielding door for a shielded enclosure. The shielding door includes a door leaf hingedly attached to a door frame. The door leaf has an acoustically insulated core, and a shielding media sheathes the acoustically insulated core of the door leaf. A conductive contact channel is attached to a perimeter of the door leaf, and the conductive contact channel is electro-mechanically bonded to the shielding media. A removable conductive angled contact is attached to a bottom of the door leaf. The shielding door also includes a radio frequency contact and an acoustic and/or radio frequency gasket seal assembly.

The door frame of the shielding door has a door head, a door sill and a door jamb. The door sill includes a steel or stainless steel threshold electro-mechanically connected to the door frame. In addition, a piano-type hinge is attached to the door leaf and the door frame. The door leaf may include a decorative finish sheathing the shielding media. The conductive contact channel and/or the conductive angled contact may be formed of silver, copper, gold, aluminum, zinc, lithium, nickel, stainless steel or an alloy thereof, such as brass.

The radio frequency contact can be constructed as one or more a single row of low pressure tin plated beryllium copper electrical contact strips. The shielding door can include radio frequency contacts attached to the door jambs and the door head and in electrical contact with the conductive contact channel when the door is in a closed position. Moreover, the shielding door can include a radio frequency contact attached to the door sill that is in electrical contact with the conductive angled contact when the door is in a closed position.

In addition, the gasket seal assembly of the shielding door is adjustable in order to form a complete acoustic and/or RF seal between the door leaf and the door frame. The gasket seal assembly includes a generally U-shaped housing having a neoprene or electrically conductive seal connected to a seal retainer. The seal retainer is adjustable using an adjustment fastener. A pair of side gasket seal assemblies is attached to the door jambs of the door frame, and is in sealed contact with the door leaf when the door is in a closed position. An upper gasket seal assembly is attached to the door head of the door frame, and is in sealed contact with the door leaf when the door is in a closed position. A lower gasket seal assembly is attached to the door leaf of the door, and is in sealed contact with the door sill when the door is in a closed position. The lower acoustic gasket seal assembly has an outer neoprene seal retained within seal grooves of the seal retainer, and the lower acoustic gasket seal assembly also has an automatic adjustment assembly. The automatic adjustment assembly includes an activating plunger connected to a magnet and a steel actuating plate, and the actuating plate is in contact with the seal retainer. The RF acoustic gasket seal assembly includes a conductive spring connected to a seal retainer within a housing of the gasket seal assembly.

DETAILED DESCRIPTION OF THE INVENTION

Figure 1:
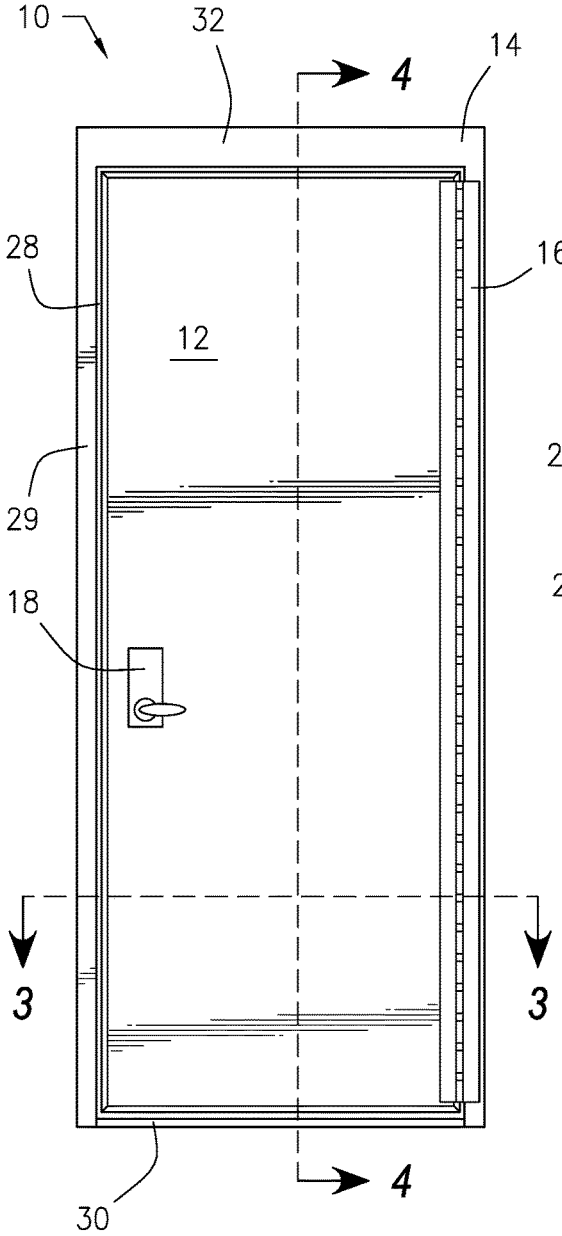
FIG. 1 is an interior elevation view of an example of an RF and acoustic shielding door in accordance with an illustrative embodiment of the invention disclosed herein.
Figure 2:
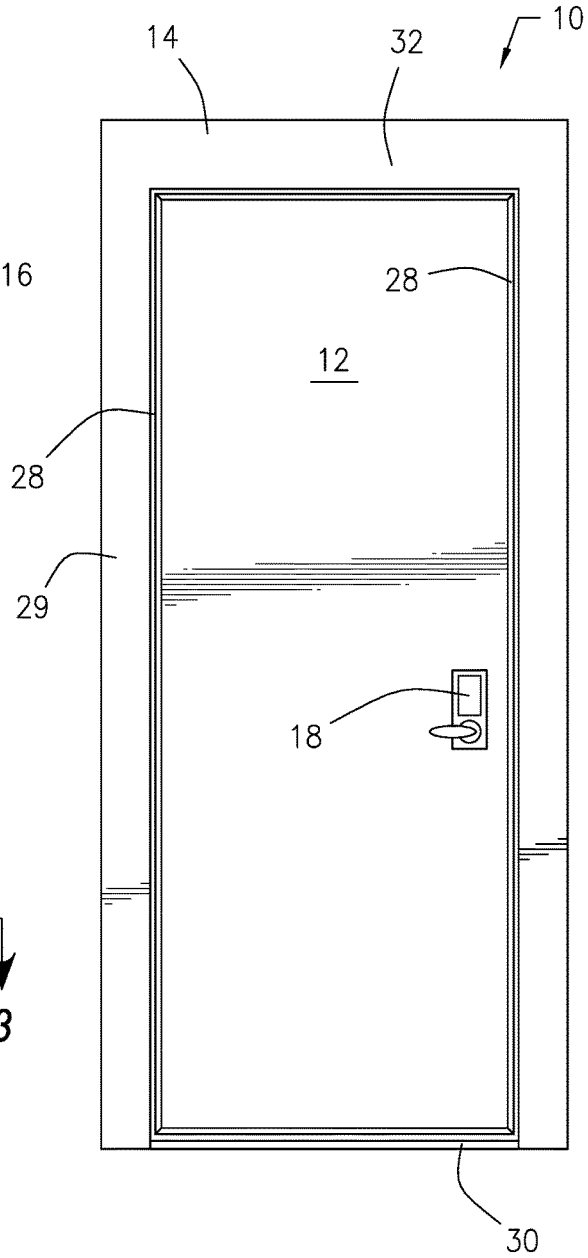
FIG. 2 is an exterior elevation view of the RF and acoustic shielding door shown in FIG. 1.

The devices and methods discussed herein are merely illustrative of specific manners in which to make and use this invention and are not to be interpreted as limiting in scope.

While the invention has been described with a certain degree of particularity, it is to be noted that many modifications may be made in the details of the construction and the arrangement of the elements and components of the devices and/or in the sequences and steps of the methods without departing from the scope of this disclosure. It is understood that the devices and methods are not limited to the embodiments set forth herein for purposes of exemplification.

The description of the invention is intended to be read in connection with the accompanying drawings, which are to be considered part of the entire written description of this invention. In the description, relative terms such as "front," "rear," "lower," "upper," "horizontal," "vertical," "above," "below," "up," "down," "top" and "bottom" as well as derivatives thereof (e.g., "horizontally," "downwardly," "upwardly" etc.) should be construed to refer to the orientation as then described or as shown in the drawings under discussion. These relative terms are for convenience of description and do not require that the machine be constructed or the process to be operated in a particular orientation. Terms, such as "connected," "connecting," "attached," "attaching," "join" and "joining" are used interchangeably and refer to one structure or surface being secured to another structure or surface or integrally fabricated in one piece.

Referring to the figures of the drawings, wherein like numerals of reference designate like elements throughout the several views, a radio frequency (RF) and acoustic shielding door 10 having improved RF and acoustic attenuation for a shielded enclosure (not shown). The shielding door 10 is designed for commercial and security applications, and it provides the opening and closing forces associated with a conventional entry door. In addition, the shielding door 10 may include single or double cylinder deadbolts, door closers, magnetic switches, medium or high security combination locks or other specified door hardware to suit the particular application.

As illustrated in Table 1 below, the shielding door 10 exceeds the shielding effectiveness requirements of NSA 73-2A, IEEE 299, NACSIM 5204.

TABLE 1

S/E values based on minimum performance.

| Magnetic Field | | Electric Field | | Plane wave | | Microwave | |
|---|---|---|---|---|---|---|---|
| 10 KHz | 30 dB | 10 KHz | 100 dB | 50 MHz | 100 dB | 2 GHz | 70 dB |
| 100 KHz | 50 dB | 100 KHz | 100 dB | 100 MHz | 80 dB | 4 GHz | 65 dB |
| 1 MHz | 60 dB | 1 MHz | 100 dB | 400 MHz | 80 dB | 8 GHz | 60 dB |
| 10 MHz | 75 dB | 10 MHz | 100 dB | 1000 MHz | 75 dB | 10 GHz | 60 dB |
| 30 MHz | 90 dB | 30 MHz | 100 dB | | | 12 GHz | 55 dB |
| | | | | | | 18 GHz | 40 dB |

The shielding door 10 includes a door leaf 12 that is hingedly attached to a door frame 14, which may be a portion of the wall of the shielded enclosure to which the shielding door 10 is mounted. The door leaf 12 is mounted to the door frame 14 using a commercial grade, full surface, security, piano-type hinge 16 that designed and installed so there is no contact between RF contacts 28 and the hinge 16. The shielding door 10 is illustrated as a single door, but is not so limited; the shielding door 10 can be constructed as a double door. The door leaf 12 of the shielding door 10 also includes a passage lockset 18 that complies with applicable Americans with Disabilities Act (ADA), the Uniform Federal Accessibility Standards and ANSI 156.2, Series 4000, Grade 1 requirements and presents the image of a conventional office lockset.

The door leaf 12 has an acoustically insulated core 20 that is sheathed with a shielding media 22, which in turn may be sheathed with a decorative finish 21 such as a wood veneer or a high pressure plastic laminate. The perimeter of the door leaf 12 is banded with a conductive contact channel 24 that is electro-mechanically bonded to the shielding media 22. In addition, a removable conductive angled contact 26 is mechanically attached at a bottom of the door leaf 12. The conductive contact channel 24 and/or the conductive angled contact 26 can be any suitable conductive material, such as silver, copper, gold, aluminum, zinc, lithium, nickel, stainless steel or an alloy thereof, such as brass. The door leaf 12 and the door frame 14 may be furnished as a complete assembly, and the shielding door 10 can also include an air trap or spring bronze gasket 19 in sealing engagement with the conductive angled contact 26 and the door leaf 12. The door sill 30 includes a steel or stainless steel threshold that is electro-mechanically connected to the door frame 14. In addition, the door sill 30 may be single or double tapered to suit the particular application. Moreover, the door sill 30 may be configured in an ADA flush sill or a raised sill configuration.

Figure 3:
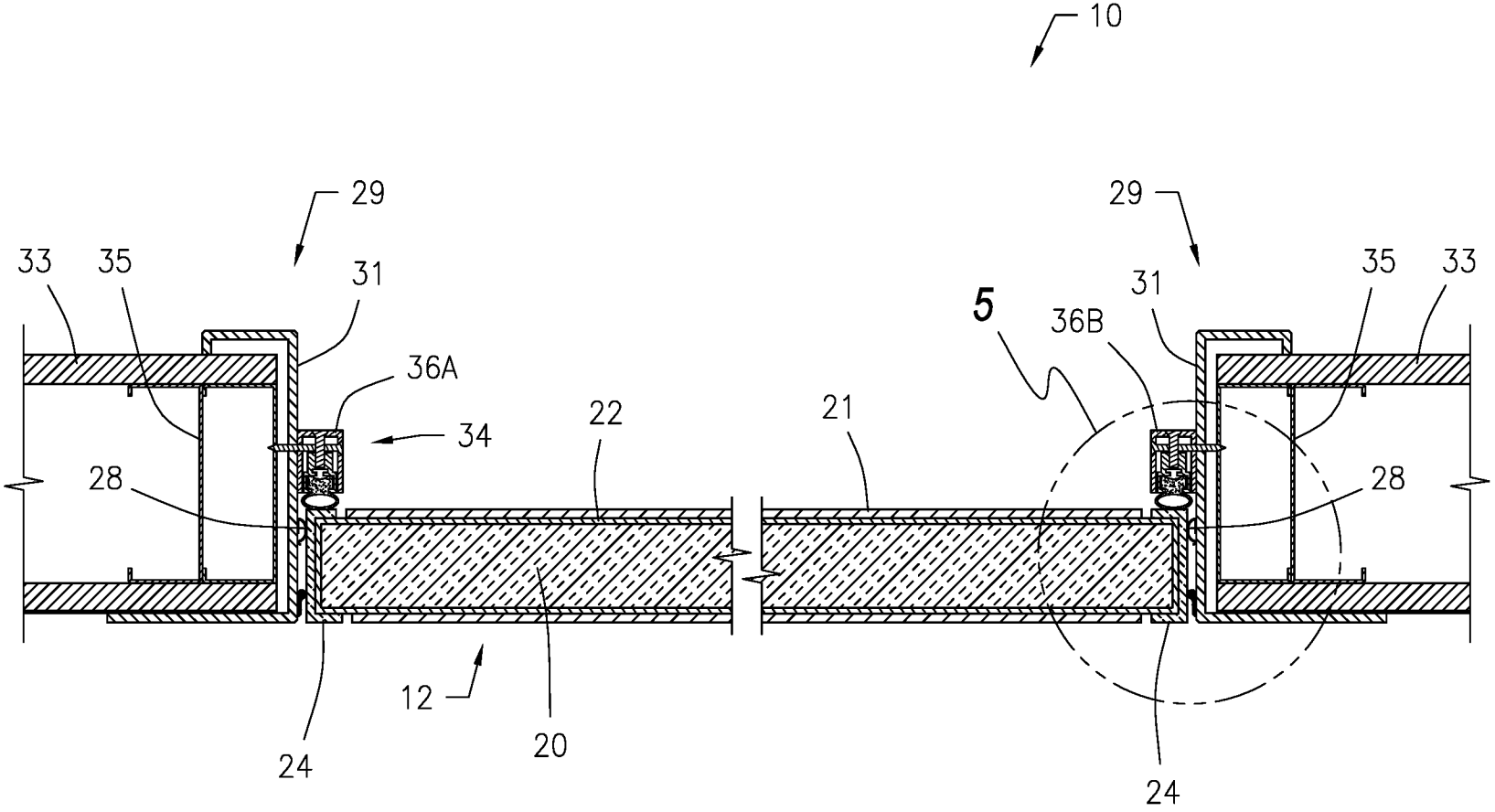
FIG. 3 is a cross-sectional view along lines 3-3 of the RF and acoustic shielding door shown in FIG. 1.
Figure 4:
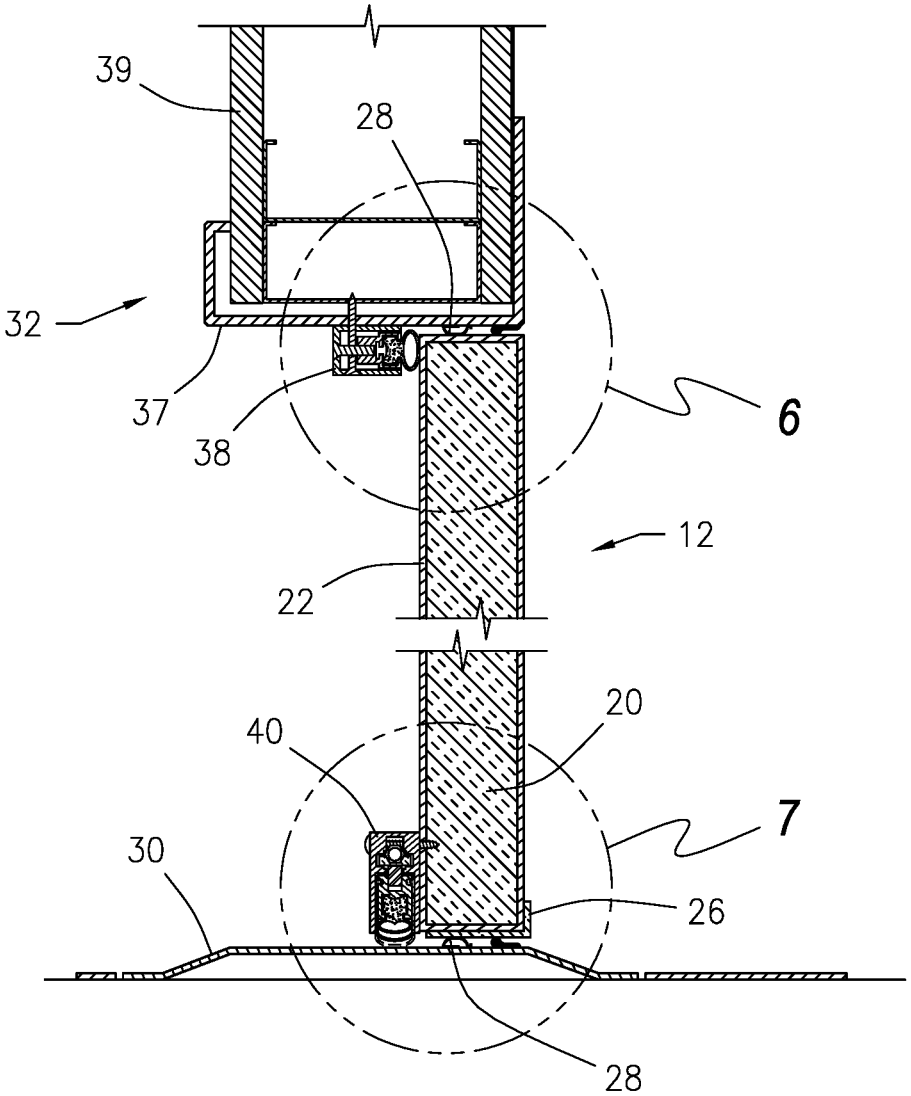
FIG. 4 is a cross-sectional view along lines 4-4 of the RF and acoustic shielding door shown in FIG. 1.

The RF contacts 28 of the shielding door 10 are attached to the jambs 29, the sill and the head 32 of the door frame 14. As illustrated in FIG. 3, the jambs 29 of the door frame include a mounting flange 31 that is in electrical contact with a jamb foil shielding media 33. The door frame 14 can also include steel studs 35. Similarly as illustrated in FIG. 4, the head 32 of the door frame 14 includes a mounting flange 37 that is in electrical contact with a header foil shielding media 39. The mounting flange 31 and/or the mounting flange 37 may be constructed of suitable materials, such as 11-gauge galvanized steel. The mounting flange 31 and the mounting flange 37 of the door frame 14 allow the shielding door 10 to attain a very high level of electrical conduction between the shielding media 22, the door frame 14, the door leaf 12 and the jamb and header foil shielding medias 33 and 39. The RF contacts 28 are constructed as a single row of low pressure tin plated beryllium copper electrical contact strips. The RF contacts 28 in the doorjambs and the head 32 make electrical contact with the conductive contact channel 24, while the door sill 30 make electrical contact with the angled contact 26 when the shielding door 10 is closed.

As noted above, the core 20 of the door leaf 12 may be acoustically insulated, and the shielding door 10 includes at least one acoustic or RF gasket seal assembly 34. As shown in FIG. 3, the shielding door 10 includes a pair of side acoustic gasket seal assemblies 36A and 36B respectively attached to the door frame 14 and in sealed contact with the door leaf 12 when the shielding door 10 is closed. FIG. 4 shows an upper acoustic gasket seal assembly 38 attached to the head 32 of the door frame 14, which is in sealed contact with the door leaf 12 when the shielding door 10 is closed. A lower acoustic gasket seal assembly 40 is attached to the bottom of the door leaf 12 and makes sealed contact with the door sill 30 when the shielding door 10 is closed. Each of the acoustic gasket seal assemblies 34 is adjustable so that a complete seal can be formed around the head 32, the jambs 29 and the sill 30 of the door frame 14 since door alignment is a common problem and any unsealed gaps allow sound to travel through the shielding door 10.

Figure 5:
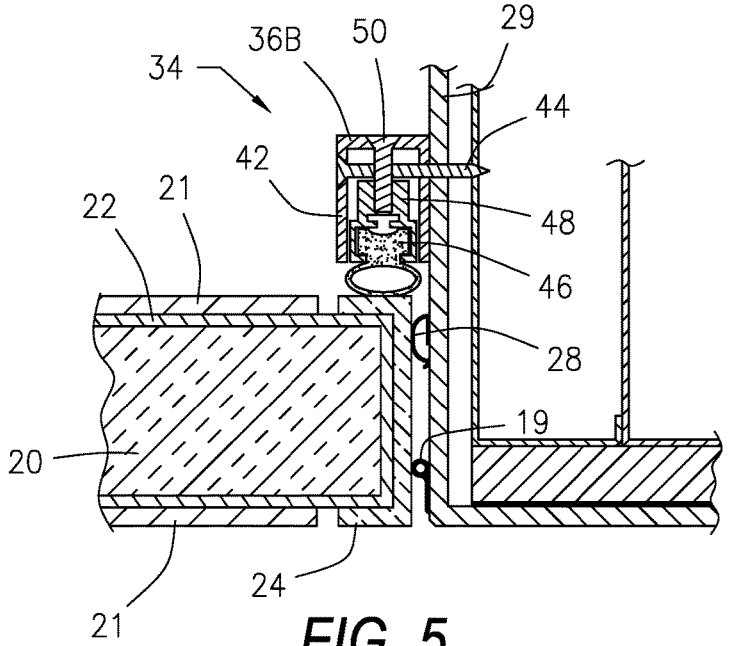
FIG. 5 is an exploded view of area 5 of the RF and acoustic shielding door shown in FIG. 3.
Figure 6:
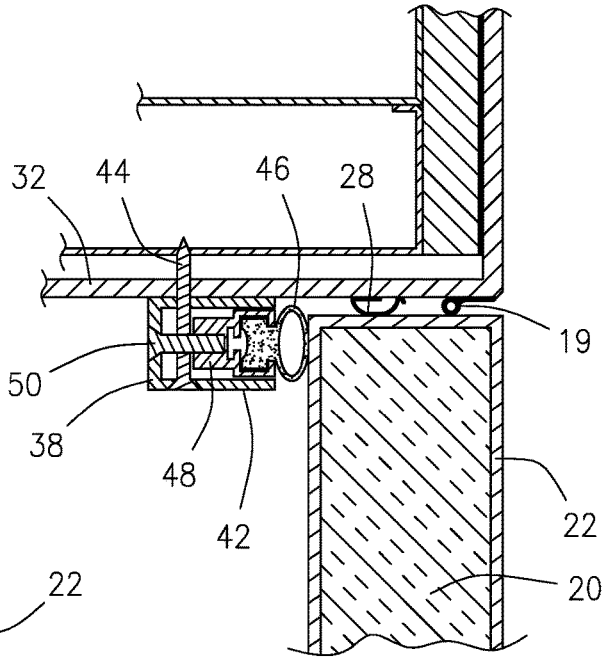
FIG. 6 is an exploded view of area 6 of the RF and acoustic shielding door shown in FIG. 4.
Figure 7:
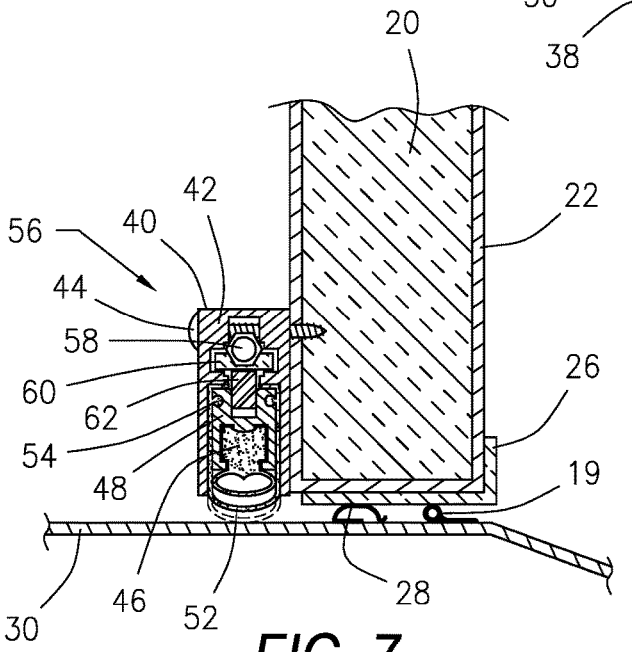
FIG. 7 is an exploded view of area 7 of the RF and acoustic shielding door shown in FIG. 4.

Referring now to FIGS. 5 through 7, each of the gasket seal assemblies 34 may be an acoustic gasket seal assembly having a generally U-shaped housing 42 attached to the shielding door 10 using an attachment fastener 44. Each of the acoustic gasket seal assemblies 34 also includes a neoprene seal 46 connected to a seal retainer 48. The seal retainer 48 of the side acoustic gasket seal assemblies 36A and 36B and the upper acoustic gasket seal assembly 38 are adjustably retained within the housing 42 of the acoustic gasket seal assemblies 34 using an adjustment fastener 50. The lower acoustic gasket seal assembly 40 attached to the bottom of the door leaf 12 includes an outer neoprene seal 52 retained within seal grooves 54 of the seal retainer 48. In addition, the lower acoustic gasket seal assembly 40 includes an automatic adjustment assembly 56. The adjustment assembly 56 includes an activating plunger 58 connected to a magnet 60 and a steel actuating plate 62, which is in contact with the seal retainer 48. As illustrated in FIG. 7, when the door leaf 12 is closed, the activating plunger 58 moves the magnet 60, which in turn actuates the steel plate 62 resulting in the seal retainer 48 with the neoprene seal 46 and the outer neoprene seal 52 moving into sealed engagement with the door sill 30.

Figure 9:
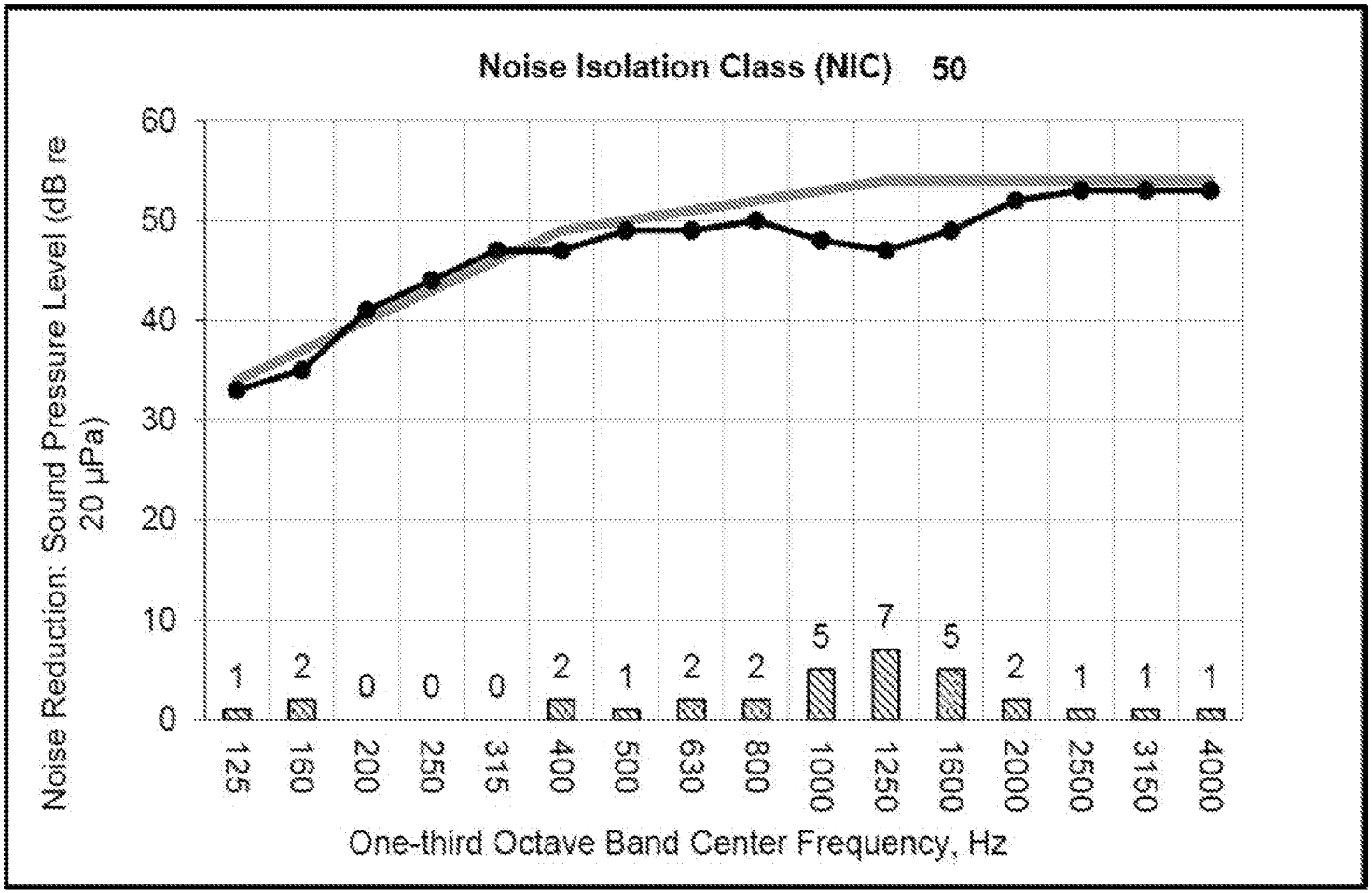
FIG. 9 is a graphical illustration of the noise reduction provided by the RF and acoustic shielding door.

The shielding door 10 has the acoustic attention characteristics illustrated below in Table 2 and in FIG. 9:

TABLE 2

Noise Isolation Class Test.

| Frequency Band (Hz) | Source Level, $L_P$ (dB) | Receiver Level, $L_P$ (dB) | NR (dB) | Ambient Level, $L_P$ (dB) | Ambient Flags | |
|---|---|---|---|---|---|---|
| 125 | 100 | 67 | 33 | 36 | | |
| 160 | 103 | 68 | 35 | 34 | | |
| 200 | 103 | 62 | 41 | 34 | | |
| 250 | 99 | 55 | 44 | 36 | | |
| 315 | 93 | 47 | 47 | 29 | | NIC |
| 400 | 86 | 38 | 47 | 26 | | 50 |
| 500 | 85 | 36 | 49 | 28 | | |
| 630 | 90 | 41 | 49 | 23 | | |
| 800 | 87 | 37 | 50 | 21 | | |
| 1000 | 85 | 37 | 48 | 23 | | |
| 1250 | 82 | 34 | 47 | 22 | | |
| 1600 | 83 | 33 | 49 | 21 | | |
| 2000 | 83 | 31 | 52 | 19 | | |
| 2500 | 85 | 32 | 53 | 19 | | |
| 3150 | 85 | 33 | 53 | 22 | | |
| 4000 | 85 | 32 | 53 | 21 | | |
| Source Level at one meter from tested surface (dB, flat, 125-4 k) | | | | | | 109 |
| Receiver Level at one meter from tested surface (dB, flat, 125-4 k) | | | | | | 77 |

Figure 8:
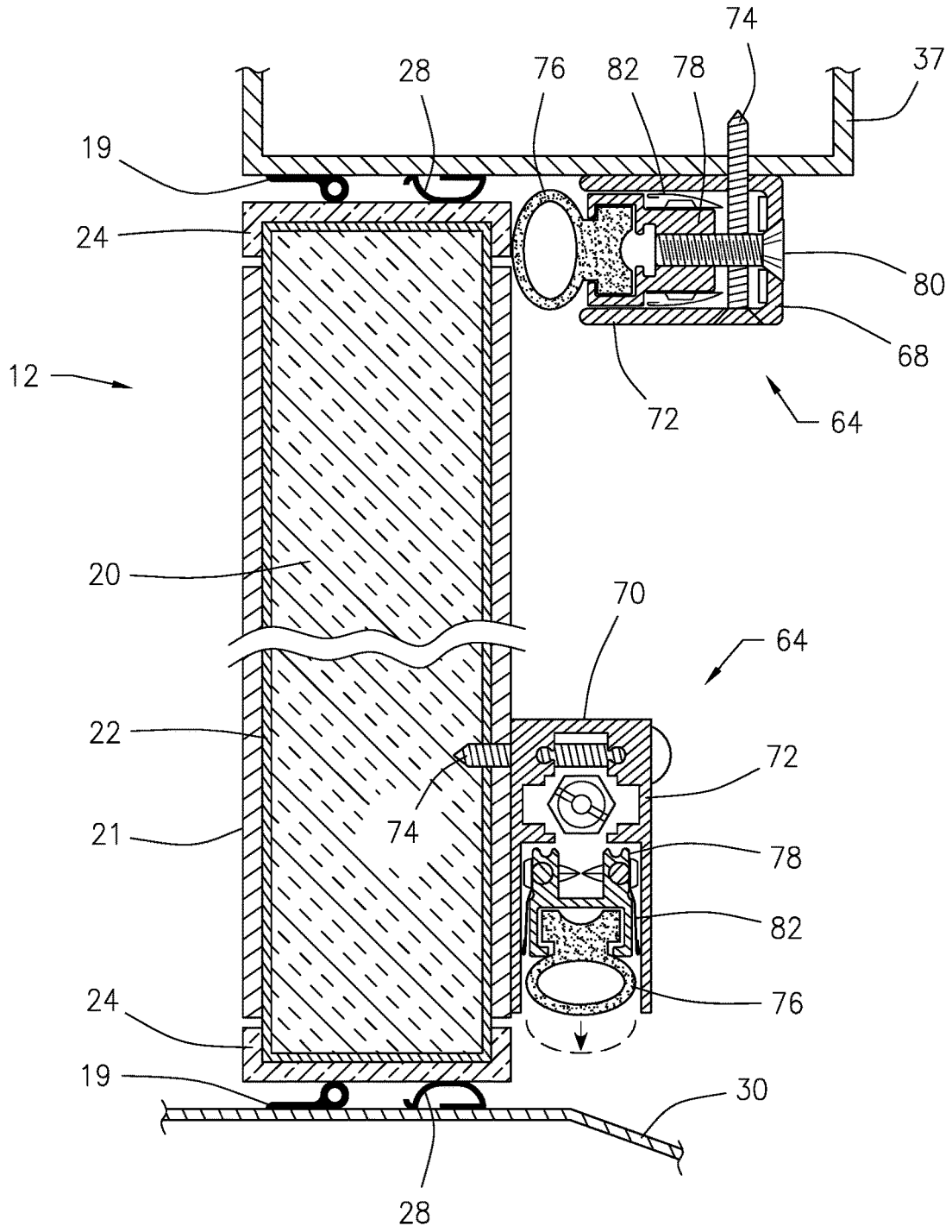
FIG. 8 is a cross-sectional view along lines 4-4 of the RF and acoustic shielding door shown in FIG. 1 in accordance with another illustrative embodiment of the invention disclosed herein.

Turning now to FIG. 8, the gasket seal assemblies 34 may be an RF gasket seal assembly 64. The shielding door 10 may include a pair of side RF gasket seal assemblies 68 respectively attached to the door frame 14 and in sealed contact with the door leaf 12 when the shielding door 10 is closed. An upper RF gasket seal assembly 68 attached to the mounting flange 37 of the head 32 of the door frame 14, which is in RF sealed contact with the door leaf 12 when the shielding door 10 is closed. A lower RF gasket seal assembly 70 is attached to the bottom of the door leaf 12 and makes sealed contact with the door sill 30 when the shielding door 10 is closed. Each of the RF gasket seal assemblies 64 is adjustable so that a complete RF seal can be formed around the head 32, the jambs 29 and the sill 30 of the door frame 14 since door alignment is a common problem and any unsealed gaps allow radio waves to travel through the shielding door 10.

Each of the RF gasket seal assemblies 64 have a generally U-shaped housing 72 attached to the shielding door 10 using an attachment fastener 74. Each of the RF gasket seal assemblies 64 also includes an electrically conductive seal 76 connected to a seal retainer 78. The seal retainer 78 of the RF gasket seal assemblies 34 are adjustably retained within the housing 72 using an adjustment fastener 80. In addition, the RF gasket seal assemblies 64 include a bronze spring 82 attached to the seal retainer 78.

Whereas, the invention has been described in relation to the drawings and claims, it should be understood that other and further modifications, apart from those shown or suggested herein, may be made within the scope of this invention.

What is claimed is:

1. A radio frequency and acoustic shielding door, comprising:

a door leaf hingedly attached to a door frame, said door leaf having an acoustically insulated core;

a shielding media sheathing said acoustically insulated core of said door leaf;

a conductive contact channel attached to a perimeter of said door leaf, said conductive contact channel electro-mechanically bonded to said shielding media;

a conductive angled contact attached to a bottom of said door leaf;

a radio frequency contact electro-mechanically attached to said door frame; and an acoustic or radio frequency gasket seal assembly attached to said door.

2. The door of claim 1 wherein said door frame comprises a door head, a door sill and a doorjamb.

3. The door of claim 2 wherein said door sill comprises a steel or stainless steel threshold electro-mechanically connected to said door frame.

4. The door of claim 1 further comprising a piano hinge attached to said door leaf and said door frame.

5. The door of claim 1 wherein said leaf further comprises a decorative finish sheathing said shielding media.

6. The door of claim 1 wherein said conductive contact channel or said conductive angled contact is chosen from a group consisting of: silver, copper, gold, aluminum, zinc, lithium, nickel, stainless steel and an alloy thereof.

7. The door of claim 6 wherein said alloy is brass.

8. The door of claim 1 wherein said radio frequency contact comprises a single row of low pressure tin plated beryllium copper electrical contact strip.

9. The door of claim 8 further comprising a plurality of single row of low pressure tin plated beryllium copper electrical contact strips.

10. The door of claim 1 further comprising said radio frequency contact attached to said door jambs and said door head, and wherein said radio frequency contacts attached to said door jambs and said door head are in electrical contact with said conductive contact channel when said door is in a closed position.

11. The door of claim 1 further comprising said radio frequency contact attached to said door sill, and wherein said radio frequency contacts attached to said door sill are in electrical contact with said conductive angled contact when said door is in a closed position.

12. The door of claim 1 wherein said acoustic or radio frequency gasket seal assembly is a plurality of acoustic or radio frequency gasket seal assemblies.

13. The door of claim 12 further comprising a pair of side acoustic or radio frequency gasket seal assemblies attached to said door jambs of said door frame, and wherein said side or radio frequency acoustic gasket seal assemblies are in sealed contact with said door leaf when said door is in a closed position.

14. The door of claim 12 further comprising an upper acoustic or radio frequency gasket seal assembly attached to said door head of said door frame, and wherein said upper acoustic or radio frequency gasket seal assembly is in sealed contact with said door leaf when said door is in a closed position.

15. The door of claim 12 further comprising a lower acoustic or radio frequency gasket seal assembly attached to said door leaf of said door, and wherein said lower acoustic or radio frequency gasket seal assembly is in sealed contact with said door sill when said door is in a closed position.

16. The door of claim 15 wherein said lower acoustic gasket seal assembly further comprises an automatic adjustment assembly.

17. The door of claim 12 wherein each of said acoustic or radio frequency gasket seal assemblies is adjustable in order to form a complete acoustic or radio frequency seal between said door leaf and said door frame.

18. The door of claim 17 wherein each of said acoustic or radio frequency gasket seal assemblies comprises a generally U-shaped housing having a neoprene or electrically conductive seal connected to a seal retainer, and wherein said seal retainer is adjustable using an adjustment fastener.

19. The door of claim 18 wherein said lower acoustic gasket seal assembly further comprises an outer neoprene seal retained within seal grooves of the seal retainer.

20. The door of claim 12 wherein each of said radio frequency gasket seal assemblies further comprises a conductive spring connected to a seal retainer within a housing.

* * * * *